US008858167B2

(12) United States Patent
Baumann

(10) Patent No.: US 8,858,167 B2
(45) Date of Patent: Oct. 14, 2014

(54) AIRFOIL SEAL

(75) Inventor: Paul W. Baumann, Amesbury, MA (US)

(73) Assignee: United Technologies Corporation, Hartford, CT (US)

( * ) Notice: Subject to any disclaimer, the term of this patent is extended or adjusted under 35 U.S.C. 154(b) by 461 days.

(21) Appl. No.: 13/212,709

(22) Filed: Aug. 18, 2011

(65) Prior Publication Data

US 2013/0045088 A1 Feb. 21, 2013

(51) Int. Cl.

| | |
|---|---|
| ***F01D 5/20*** | (2006.01) |
| ***F01D 11/08*** | (2006.01) |
| ***F01D 5/14*** | (2006.01) |
| ***F01D 11/00*** | (2006.01) |

(52) U.S. Cl.

CPC ..... *F01D 5/141* (2013.01); *F01D 11/001* (2013.01)

USPC ..... 415/173.4; 415/173.7; 415/174.4

(58) Field of Classification Search

USPC ..... 415/173.4, 174.4, 173.6

See application file for complete search history.

(56) References Cited

U.S. PATENT DOCUMENTS

| | | | | |
|---|---|---|---|---|
| 4,540,339 | A | 9/1985 | Horvath | |
| 4,589,823 | A * | 5/1986 | Koffel | 416/92 |
| 5,476,363 | A * | 12/1995 | Freling et al. | 415/173.1 |
| 6,086,328 | A * | 7/2000 | Lee | 416/97 R |
| 6,190,124 | B1 * | 2/2001 | Freling et al. | 415/173.4 |
| 6,206,638 | B1 * | 3/2001 | Glynn et al. | 416/97 R |
| 6,382,913 | B1 | 5/2002 | Lee et al. | |
| 6,602,052 | B2 | 8/2003 | Liang | |
| 6,616,410 | B2 | 9/2003 | Grylls et al. | |
| 6,991,430 | B2 | 1/2006 | Stec et al. | |
| 7,029,235 | B2 * | 4/2006 | Liang | 416/92 |
| 7,281,894 | B2 | 10/2007 | Lee et al. | |
| 7,837,446 | B2 | 11/2010 | McMillan | |
| 2008/0219835 | A1 * | 9/2008 | Freling et al. | 415/173.4 |
| 2012/0128497 | A1 * | 5/2012 | Rowley et al. | 416/185 |

* cited by examiner

*Primary Examiner* — Edward Look
*Assistant Examiner* — Michael Sehn
(74) *Attorney, Agent, or Firm* — Kinney & Lange, P.A.

(57) ABSTRACT

A gas turbine engine component has an airfoil and a squealer tip. The airfoil has a pressure side and a suction side. The squealer tip is located at one end of the airfoil to engage with an adjacent surface and thereby form a seal. The squealer tip terminates in a squealer tip apex with an arched cross-sectional profile in a plane extending from the pressure side to the suction side of the airfoil. A method for producing an airfoil seal for the gas turbine engine component is also provided.

23 Claims, 3 Drawing Sheets

AIRFOIL SEAL

BACKGROUND

The present invention relates generally to an airfoil seal arrangement, and more particularly to an arrangement of a gas turbine engine having airfoils with squealer tips.

A gas turbine engine comprises a compressor that pressurizes air, a combustor that mixes pressurized air from the compressor with fuel and ignites the resulting fuel-air mixture, and a turbine that extracts energy from the ignited mixture downstream of the combustor. Both the compressor and turbine includes a plurality of airfoil elements, often in multiple stages. These airfoil elements comprise rotor blades and stator vanes located in airflow passages generally defined by gas turbine engine casings, rotors, and shrouds. Rotor blades rotate relative to stator vanes that generally remain stationary with respect to the body of the gas turbine engine. Airflow leakage around the tips of blades and vanes at respective outer and inner airflow diameters of airflow passages reduces gas turbine engine efficiency. To avoid this, a compressor is conventionally constructed with a minimal gap between blade or vane tips and adjacent stationary or rotating surfaces, respectively. Blades and vanes need not form perfect air seals with these adjacent surfaces, but are designed to reduce gas bleed. To this end, squealer tips of blades and vanes are commonly manufactured with labyrinth or knife-edge seals. Some blades or vanes with knife-edge seals use thin or tapered "squealer" tips. During a break-in cycle of the gas turbine engine, these squealer tips are abraded by contact with adjacent engine components. Stator vane squealer tips, for instance, make contact with an adjacent inner airflow diameter shroud or rotor land surfaces within the gas turbine engine. Frictional contact between the shroud or rotor land and the stator vane squealer tip abrades the squealer tip until only a uniform minimum gap remains between the stator vane and the rotor. This abrasion process can melt blade or vane squealer tips, and sometimes liberates abraded debris from the stator vane, rotor surface, or both. Liberated debris can reduce component lifetimes within the gas turbine engine.

SUMMARY

The present invention relates to a gas turbine engine component and a method of forming a seal with the gas turbine engine component. The gas turbine engine component has an airfoil and a squealer tip. The airfoil has a pressure side and a suction side. The squealer tip is located at one end of the airfoil to engage with an adjacent surface and thereby form a seal. The squealer tip terminates in a squealer tip apex with an arched cross-sectional profile in a plane extending from the pressure side to the suction side of the airfoil. A method for producing an airfoil seal for the gas turbine engine component is also provided.

DETAILED DESCRIPTION

Figure 1:
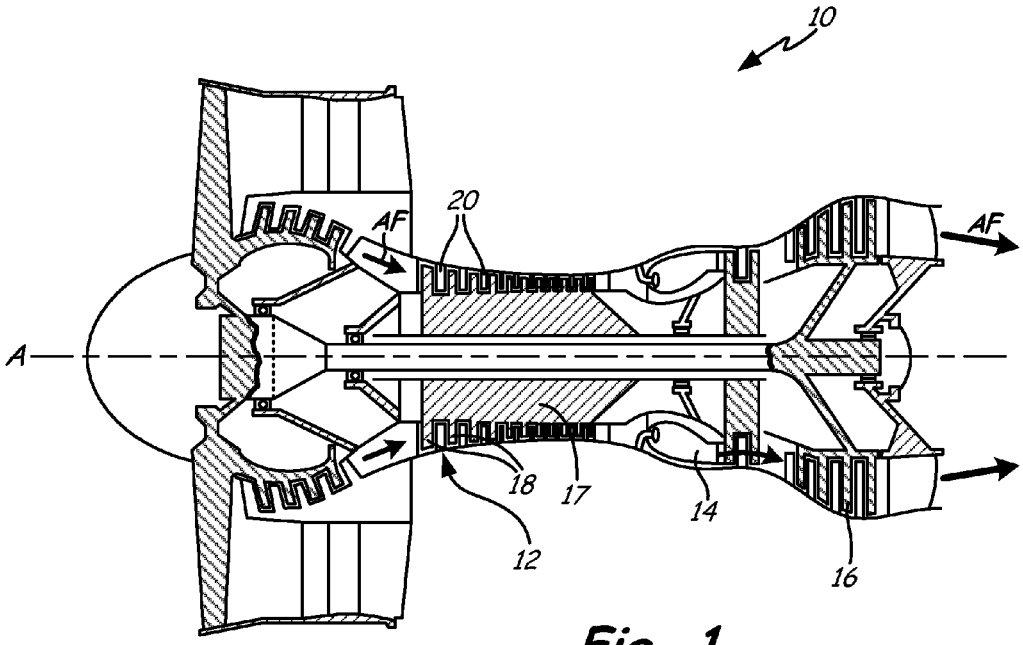
FIG. 1 is a simplified cross-sectional view of a gas turbine engine comprising a compressor, a combustor, and a turbine.

FIG. 1 is a simplified cross-sectional view of gas turbine engine 10, comprising compressor 12, combustor 14, and turbine 16. Compressor 12 has stator vanes 20 and rotor 17 with rotor blades 18. Turbine 16 drives rotor 17 of compressor 12, and may also drive an electrical generator (not shown). In some embodiments, compressor 12 and turbine 14 may have a plurality of stages. Air flows along indicated airflow path AF through gas turbine engine 10. Compressor 12 receives and pressurizes atmospheric gas or air by rotational movement of rotor blades 18 relative to stator vanes 20 and about rotational axis A. Rotor blades 18 and stator vanes 20 are rigid airfoil elements with pressure and suction sides that pressurize and decelerate gas, respectively. Fuel is injected into combustor 14, where it mixes with pressurized gas from combustor 12. Combustor 14 ignites the resulting fuel-air mixture, increasing the temperature of the gas. Turbine 16 extracts mechanical energy from hot, high-pressure gas downstream of combustor 14.

Gas leakage along airflow path AF around inner or outer radial extents of rotor blades 18 or stator vanes 20 results in diminished compression efficiency. To reduce such leakage, stator vane 20 is formed with a narrow squealer tip that minimizes a gap distance between stator vane 20 and an adjacent surface, such as a shroud or a rotor surface, as described below with respect to squealer tips 28 of FIGS. 2, 3*a*, and 3*b*.

Figure 2:
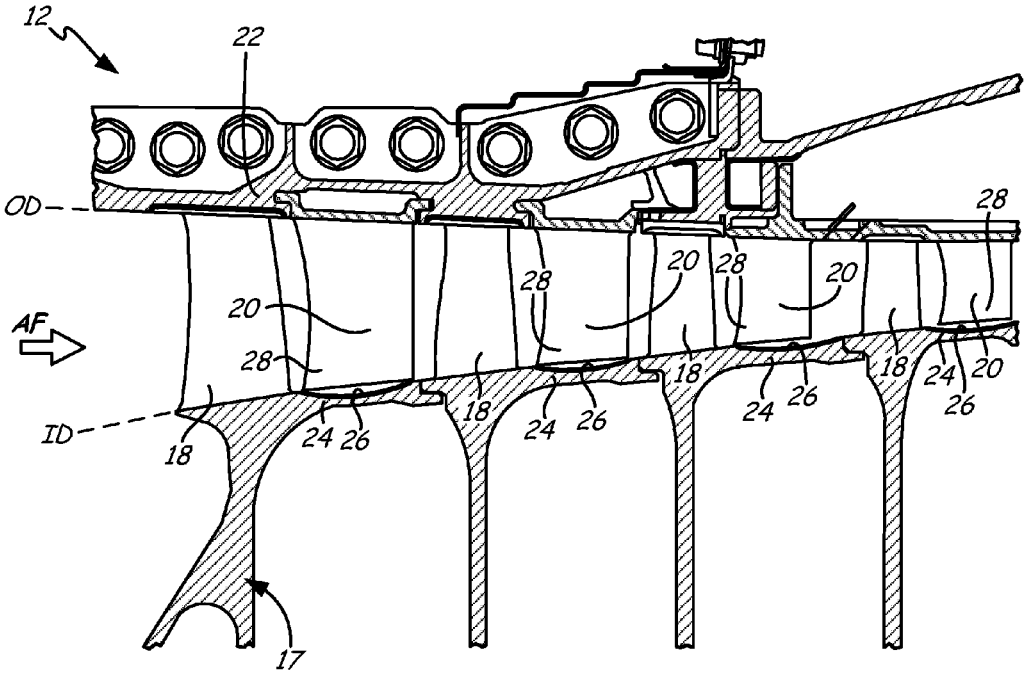
FIG. 2 is a cross-sectional view of the compressor of FIG. 1.

FIG. 2 is a simplified cross-sectional view of a section of compressor 12 of gas turbine engine 10. Compressor 12 comprises rotor 17, rotor blades 18, stator vanes 20, casing 22, rotor land 24, and abrasive layer 26. Each stator vane 20 has squealer tip 28, a sacrificial section at the innermost radial extent of stator vane 20. In the depicted embodiment, stator vane 20 is mounted on casing 22 of compressor 12, and projects generally radially inward from outer diameter OD to squealer tip 28 of vane 20 near rotor land 24 carried by rotor 17, generally at inner diameter ID. In some embodiments, compressor 12 may further include shrouds located at inner diameter ID or outer diameter OD. Rotor land 24 is a smooth portion of rotor 15 that includes a region radially adjacent to stator vane 20. In some embodiments, rotor blades 18, stator vanes 20 (including squealer tip 28), and rotor land 24 may be formed of a precipitation strengthened high Ni-based alloy, such as austenitic nickel-chromium-based superalloys IN100 or Inconel 718.

Operation of gas turbine engine 10 produces large amounts of heat, causing components to thermally expand. Different components heat and expand at different rates, causing gaps between some components—most significantly between rotating and non-rotating components—to vary over the course of each operational cycle of gas turbine engine 10.

To minimize gas leakage between squealer tip 28 and rotor land 24, squealer tip 28 is constructed to impinge slightly on rotor land 24 during a portion of an initial break-in cycle of gas turbine engine 10, because of thermal expansion. During this break-in cycle, squealer tip 28 contacts and rubs against rotor land 24, and is abraded or worn down such that all squealer tips 28 terminate at a uniform radius that minimizes any gap or clearance from rotor land 24, and that exhibits minimal eccentricity. In some embodiments, rotor land 24 may be coated with abrasive layer 26. Abrasive layer 26 is a thin coating of abrasive material that helps to mill or grind squealer tip 28 during the break-in cycle. Abrasive layer 26 may be formed as an ablative layer of sacrificial material deposited on rotor land 24, such as aluminum oxide or zirconium oxide. In such embodiments, both abrasive layer 26 and squealer tip 28 are abradable. During the break-in cycle, contact between squealer tip 28 and abrasive layer 26 on rotor land 24 grinds both squealer tip 28 and abrasive layer 26, thereby forming a final stator structure with little eccentricity and minimum separation between rotor land 24 and stator vane 20.

Figure 3A:
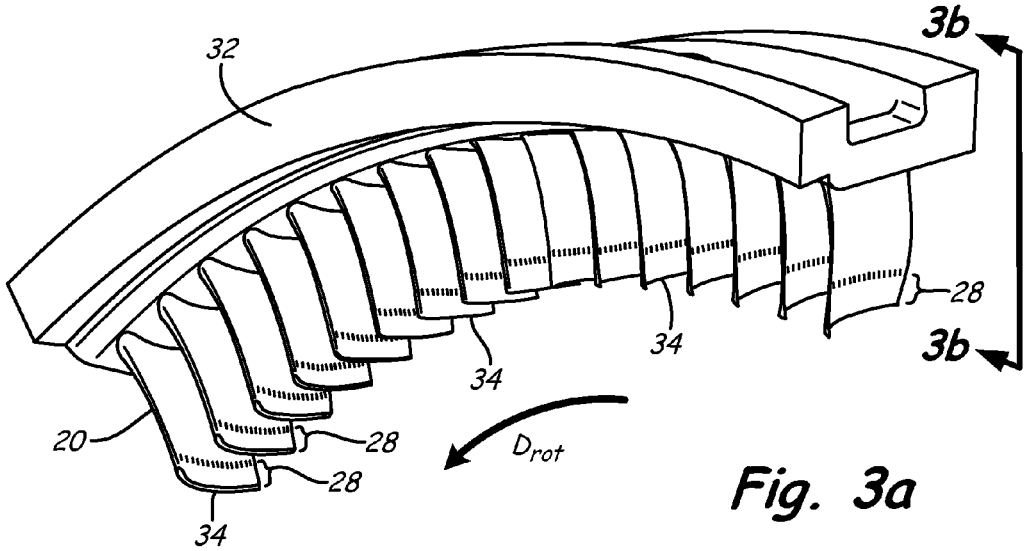
FIG. 3*a* is a perspective view of a stator section of the compressor of FIG. 2.
Figure 3B:
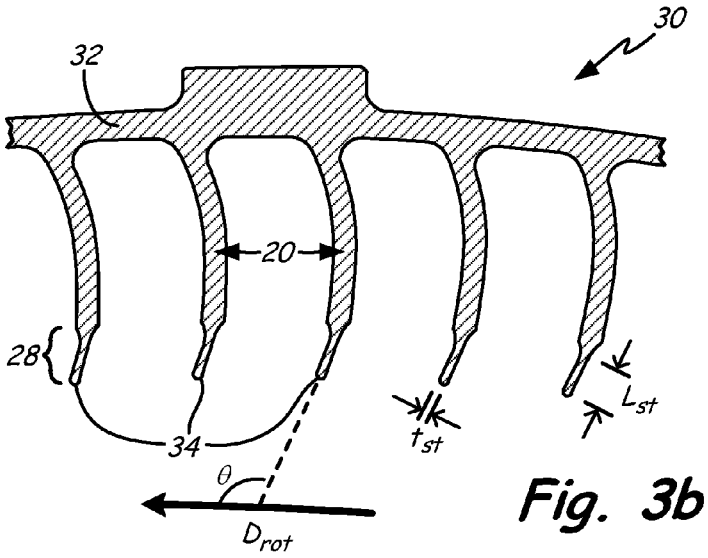
FIG. 3*b* is a cross-sectional view of the stator section of FIG. 3*a*.

FIG. 3*a* is a perspective view of stator section 30 of compressor 12. FIG. 3*b* is a cross-sectional view of stator section 30 through section plane 3*b*-3*b* of FIG. 3*a*. Section plane 3*b*-3*b* extends through pressure and suction sides of stator vanes 20. Stator section 30 forms one angular segment of a stage of stator vanes 20 of compressor 12. Stator section 30 comprises a plurality of stator vanes 20 having a common stator root 32 anchored in casing 22 (see FIG. 2), or in a compressor shroud (not shown). Stator vanes 20 each have squealer tips 28 with squealer tip edges 34. In the depicted embodiment, squealer tips 28 are elongated, tapered tips with a squealer tip thickness $t_{st}$ considerably narrower than the bodies of stator vanes 20, and squealer tip length $1_{st}>2t_{st}$. Such narrow, elongated squealer tips are widely used in the art to reduce the amount of contact between stator vanes 20 and rotor land 24, there reducing grinding and frictional heating of stator vanes 20. Squealer tips 28 may, for instance, be tapered, cast faired squealer tips at an obtuse angle Θ to direction of rotation $D_{rot}$ of adjacent rotor land 24. Squealer tips 28 may be cast-in during the formation of stator section 30, for instance to a squealer tip thickness $t_{st}$ as low as approximately 0.02 inches (~0.5 mm). Alternatively, squealer tips 28 may be ground or otherwise machined to form narrow, tapered tips.

Each squealer tip 28 has squealer tip apex 34. Squealer tip apex 34 has an arched profile which further reduces contact area between squealer tip 28 and rotor land 24. Squealer tip apex 34 may, for instance, have a circular or elliptical profile. Squealer tip 28, and in particular squealer tip apex 34, provides a narrow point of contact between stator vane 20 and rotor land 24 (see FIG. 2). Contact width $W_{contact}$ on squealer tip apex 34 increases as stator vane 20 rubs in to rotor land 24, up to a maximum of approximately the thickness of squealer tip 28, as depicted in FIG. 4 and described below.

Figure 4:
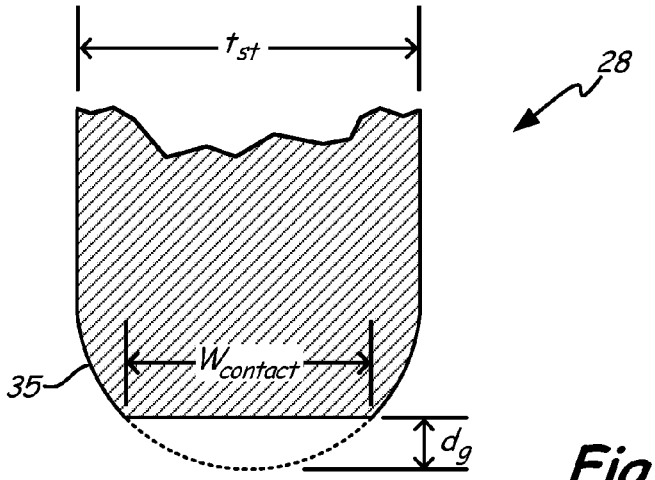
FIG. 4 is a close-up cross-sectional view of a squealer tip of a stator vane from the stator section of FIGS. 3*a* and 3*b*.

FIG. 4 is a close-up cross-sectional view of squealer tip 28 with squealer tip apex 34. FIG. 4 indicates grind distance $d_g$, squealer tip thickness $t_{st}$, and contact width $W_{contact}$ between squealer tip 28 and adjacent rotor land 24 (not shown). During a break-in cycle, squealer tip 28 and rotor land 24 abrade one another, grinding away at least a portion of squealer tip 28 such that squealer tip 28 is shortened by grind distance $d_g$. For instance, where squealer tip 28 is a narrow, tapered tip with squealer tip thickness $t_{st}$=0.02 in. (~0.5 mm), and squealer tip apex 34 has circular profile with corresponding radius 0.01 in. (~0.25 mm), stator vane 20 may have grind distance $d_g$ up to 0.001 in. (~0.25 mm). As discussed above, rotor land 24 may also be abraded during the break-in cycle.

Grinding during the break-in cycle produces a uniform inner rotor diameter ID (see FIG. 2). Over the course of the break-in cycle, the contact area between each squealer tip apex 34 and adjacent rotor land 24 increases, as squealer tip 28 is abraded. Because grind takes place primarily at depths substantially less than the radius of curvature of squealer tip edge 28 (i.e. $d_g<\frac{1}{2}t_{st}$), the contact area between stator vane 20 and rotor land 24 remains less than the thickness of squealer tip 28 during the majority of the break-in cycle. Where squealer tip apex 34 has a circular profile, for instance:

$$W_{contact}\approx 2\sqrt{t_{st}d_g-d_g^2} \qquad \text{[Equation 1]}$$

(where $W_{contact}$ is the width of the contact area at a particular grind distance $d_g$).

The circular or elliptical profile of squealer tip apex 34 thus reduces initial contact area between stator vane 20 and rotor land 24 during a break-in cycle of compressor 12. Although squealer tip 28 has been described as a narrow, tapered tip, a worker skilled in the art will recognize that providing squealer tip apex 34 with a circular or elliptical cross-sectional profile will reduce contact area between stator vane 20 and rotor land 24, even where squealer tip 28 does not narrow near squealer tip apex 34.

Reduced contact area between rotor land 24 and stator vanes 20 results in decreased frictional heating of rotor land 24 and stator vanes 20 while stator vanes 20 rub in against rotor land 24 at pinch point or points of the aforementioned break-in cycle. At high temperatures, squealer tip apex 34 can melt, rather than grind. Squealer tip apex 34 reduces melting by minimizing contact area between stator vanes 20 and rotor land 24, thereby reducing frictional heating. Additionally, the narrow cross-section of squealer tips 28 results in a low total volume of material ablated from stator vanes 20 and rotor land 24 (or abrasive layer 26 on rotor land 24), and thus a decrease in liberated debris. Although the preceding discussion has focused on a squealer tip structure that reduces contact area between stator vanes 20 and rotor land 24 (or abrasive layer 26 thereon), a worker skilled in the art will recognize that some compressor rotor blades 18 may also benefit from squealer tips with arched profiles at their radially outermost extents, which reduce contact area between rotor blades 18 and radially adjacent shroud or casing sections. Similarly, although the preceding discussion has focused on air seals for compressor 12, squealer tips with arched profiles may also be provided for rotor blades or stator vanes of turbine 16.

Figure 5:
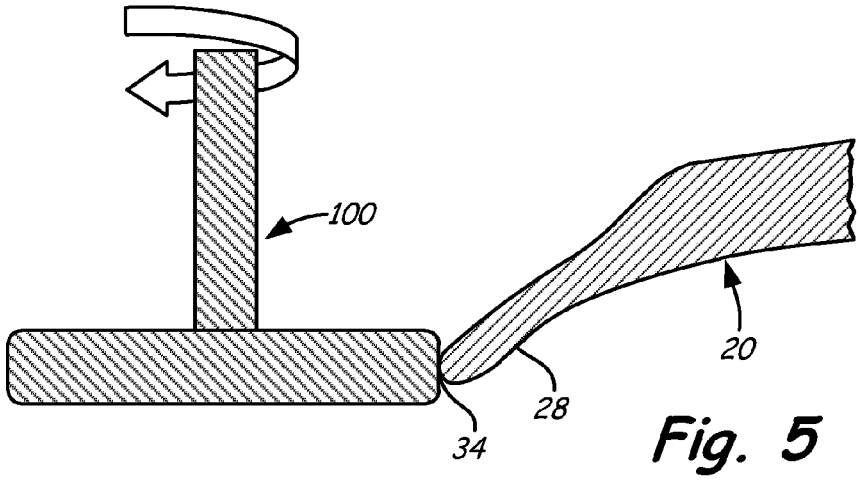
FIG. 5 is close-up cross-sectional view of a machining step for forming the squealer tip of FIG. 4.

FIG. 5 is a close-up cross-sectional view of a machining step for stator vane 20. In particular, FIG. 5 depicts squealer tip apex 34 of squealer tip 28 being shaped by brush wheel 100. At least one brush wheel 100 is used to shape the rounded cross-section of squealer tip apex 34, characterized above. In one embodiment, squealer tip edges 34 are machined in-case with stator vanes 20 in an assembled state to provide a close match between stator vanes 20 and rotor land 24, and a uniform inner diameter ID. In this embodiment, stator sections 30 are assembled in casing 22 (see FIG. 2), while at least one rotary brush wheel 100 is inserted in the place of rotor 17 to grind or shape squealer tip edges 34.

In one embodiment a conventional rotary grinder is used to grind squealer tip edges 34 to a uniform inner diameter ID (see FIG. 2) close to the eventual location of rotor land 24. This rotary grinder is then removed, and replaced with brush wheel 100. This brush wheel may, for instance, be a ring of nylon bristles impregnated with abrasive material such as aluminum oxide or silicon carbide. Rotation of brush wheel 100 relative to squealer tip apex 34 removes burrs left from previous machining steps, and rounds squealer tip apex 34 to produce the circular or elliptical profile previously discussed. The rotation speed of brush wheel 100 and the dwell time of the machining process are adjusted to optimize inner diameter ID and the cross-section of squealer tip edges 34. In some embodiments, stator sections 30 are also rotated about the axis of compressor 12 during these machining steps. In such embodiments, the rotation speed of stator sections 30 can also be adjusted to optimize inner diameter ID and the cross-section of squealer tip edges 34. Once squealer tip edges 34 have been machined to a desired cross-sectional profile, stator sections 30 are reassembled with other components of gas turbine engine 10.

The circular or elliptical cross-section of squealer tip apex 34 provides reduced contact area between stator vane 20 and rotor land 24. Because $d_g < t_{st}$, This reduced contact area results in less melting and less debris liberation during break-in cycles of compressor 12. Squealer tip apex 34 can be inexpensively and quickly produced using brush wheel 100.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine component comprising:

an airfoil having a pressure side and a suction side; and a metallic squealer tip located at one end of the airfoil to engage with an adjacent surface and thereby form a seal, the squealer tip terminating in a squealer tip apex that follows a continuously curved circular or elliptical cross-sectional profile in a plane extending from the pressure side to the suction side of the airfoil.

2. The gas turbine engine component of claim 1, wherein the cross-sectional profile of the squealer tip apex is circular.

3. The gas turbine engine component of claim 1, wherein the cross-sectional profile of the squealer tip apex is elliptical.

4. The gas turbine engine component of claim 1, wherein the gas turbine engine component is a gas turbine engine stator vane, and the squealer tip is the radially inner-most region of the stator vane.

5. The gas turbine engine component of claim 1, wherein the gas turbine engine component is a gas turbine engine rotor blade, and the squealer tip is the radially outer-most region of the rotor blade.

6. The gas turbine engine component of claim 1, wherein the squealer tip is a tapered section narrower than the airfoil.

7. A gas turbine engine comprising:

a compressor with a plurality of alternating stages of rotor blades on a rotor axis, and of stator vanes anchored to a compressor casing or shroud, wherein at least one of the rotor blade stages or the stator vane stages has a sacrificial squealer tip with a metallic tip apex having a cross-sectional profile with a finite radius of curvature at any given location in a radial plane extending from an airfoil suction side to an airfoil pressure side;

a combustor which receives and combusts pressurized gas from the compressor; and a turbine which extracts mechanical energy from gas from the combustor.

8. The gas turbine engine of claim 7, wherein the cross-sectional profile of the squealer tip apex is circular.

9. The gas turbine engine of claim 7, wherein the cross-sectional profile of the squealer tip apex is elliptical.

10. The gas turbine engine of claim 7, wherein the compressor further comprises a rotor land, and wherein at least one stage of stator vanes has squealer tips radially adjacent to the rotor land.

11. The gas turbine engine of claim 10, wherein the rotor land is coated with an abrasive layer capable of abrading the squealer tip.

12. The gas turbine engine of claim 11, wherein the abrasive layer is formed of a sacrificial material which can be abraded by contact with the squealer tip.

13. The gas turbine engine of claim 12, wherein the abrasive layer is formed of aluminum oxide or zirconium oxide.

14. The gas turbine engine of claim 7, wherein at least one stage of the rotor blades has squealer tips radially adjacent to the compressor casing or shroud.

15. A method of forming an airfoil seal for a gas turbine engine, the method comprising:

machining an end of the airfoil element into a rounded metallic squealer tip having a squealer tip thickness $t_{st}$ and a squealer tip apex that follows a continuously curved circular or elliptical cross-sectional profile in a plane extending from a pressure side to a suction side of the airfoil;

installing the airfoil element in a gas turbine engine such that the squealer tip apex is separated from a radially adjacent element of the gas turbine engine by a separation distance; and running the gas turbine engine through a break-in cycle wherein the separation decreases to zero, and the radially adjacent element rotates relative to the airfoil element, abrading the squealer tip and thereby shortening the squealer tip by up to a grind distance $d_g$.

16. The method of claim 15, wherein the grind distance $d_g$ is not significantly more than half the squealer tip thickness $t_{st}$.

17. The method of claim 15, wherein the radially adjacent element rotates relative to the airfoil element in a rotation direction, and wherein the squealer tip is cast-faired, and angled obtusely relative to the rotation direction.

18. The method of claim 15, wherein running the airfoil element rubs in on the radially adjacent element at a contact width $W_{contact} < t_{st}$ during majority of the break-in cycle.

19. The method of claim 18, wherein $W_{contact} \approx 2\sqrt{t_{st} d_g - d_g^2}$.

20. The method of claim 15, wherein the machining is performed with an abrasive brush ring.

21. The method of claim 15, wherein the airfoil element is abraded by an abrasive coating on the radially adjacent element when the airfoil element rubs in on the radially adjacent element.

22. The method of claim 18, wherein abrasive coating is abraded when the airfoil element rubs in on the radially adjacent element.

23. The method of claim 15, wherein the machining takes place in-case.

* * * * *